US010507510B2

(12) United States Patent
Foreman

(10) Patent No.: US 10,507,510 B2
(45) Date of Patent: Dec. 17, 2019

(54) STRIP HOLDING DEVICE FOR THE DIE OF A STAMPING SYSTEM

(71) Applicant: GM GLOBAL TECHNOLOGY OPERATIONS LLC, Detroit, MI (US)

(72) Inventor: Thomas M. Foreman, Parma, OH (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 566 days.

(21) Appl. No.: 15/281,217

(22) Filed: Sep. 30, 2016

(65) Prior Publication Data

US 2018/0093320 A1 Apr. 5, 2018

(51) Int. Cl.

| | |
|---|---|
| ***B21D 43/00*** | (2006.01) |
| ***B25B 11/00*** | (2006.01) |
| ***B21D 22/02*** | (2006.01) |
| ***B21D 43/02*** | (2006.01) |
| *B21D 37/08* | (2006.01) |

(52) U.S. Cl.

CPC ..... *B21D 43/003* (2013.01); *B21D 22/02* (2013.01); *B21D 43/023* (2013.01); *B25B 11/002* (2013.01); *B21D 37/08* (2013.01)

(58) Field of Classification Search

CPC ..... B21D 28/04; B21D 28/24; B21D 28/26; B21D 28/265; B21D 43/003; B21D 43/18; B21D 45/00; B21D 45/003; B21D 45/006; B23Q 3/15; B25B 11/002

See application file for complete search history.

(56) References Cited

U.S. PATENT DOCUMENTS

| | | | | | |
|---|---|---|---|---|---|
| 687,931 | A * | 12/1901 | Barr | B23Q 3/1543 | 335/289 |
| 2,209,558 | A * | 7/1940 | Bing | B23Q 3/1546 | 335/295 |
| 2,287,286 | A * | 6/1942 | Bing | B23B 31/28 | 335/288 |
| 2,479,584 | A * | 8/1949 | Meyer | B23B 31/28 | 279/128 |
| 2,992,580 | A * | 7/1961 | Stolk | B21D 45/00 | 83/136 |
| 3,211,035 | A * | 10/1965 | Whistler, Sr. | B21D 45/006 | 83/139 |
| 3,253,493 | A * | 5/1966 | Weisbeck | B21D 28/26 | 83/559 |
| 3,269,238 | A * | 8/1966 | Whistler, Sr. | B21D 45/006 | 83/139 |
| 3,353,822 | A * | 11/1967 | Dangelmaier | B21D 43/24 | 271/18.1 |
| 3,688,619 | A * | 9/1972 | Yabuta | B21D 43/18 | 83/35 |
| 3,812,629 | A * | 5/1974 | Campbell | B23Q 3/152 | 451/364 |

(Continued)

FOREIGN PATENT DOCUMENTS

| | | | | |
|---|---|---|---|---|
| DE | 19644513 A1 * | 6/1998 | B25B 9/00 | |
| GB | 648356 A * | 1/1951 | B21D 43/18 | |

*Primary Examiner* — Tyrone V Hall, Jr.

(57) ABSTRACT

A metal strip holding device configured to be connected to the die of a stamping system is presented herein. The strip holding device includes a magnetic component and a non-magnetic bracket. The magnetic component has at least one pole shoe. The bracket is configured to be connected to the die. Moreover, the magnetic component is installed into a cavity in the metal bracket.

19 Claims, 4 Drawing Sheets

(56) References Cited

U.S. PATENT DOCUMENTS

| | | | | |
|---|---|---|---|---|
| 5,138,919 | A * | 8/1992 | Wilhelm | B21D 45/006 83/139 |
| 7,237,421 | B2 | 7/2007 | Von Allwoerden | |
| 2009/0027149 | A1 * | 1/2009 | Kocijan | B25B 11/002 335/288 |

* cited by examiner

STRIP HOLDING DEVICE FOR THE DIE OF A STAMPING SYSTEM

INTRODUCTION

Stamping systems in metalworking often encompass punching, coining, and bending a strip of metallic stock. To accomplish this effort, a metal strip of steel is fed through a reciprocating stamping press. As the press moves up, a die moves with it, which allows the material to feed into the stamping press. When the press moves down, the die closes and performs the stamping operation. Thus, with each stroke of the press, a part can be formed, completed, and then removed from the stamping system.

As it is fed through the stamping press, metallic stock has also been known to accidentally come loose in the feed line. Once loosened, strip is apt to folding up, jamming the feed, and causing the die to crash. A strip holding device is therefore desirable to ensure the metallic stock does not come loose while being fed through stamping systems.

SUMMARY

A metal strip holding device configured to be connected to the die of a stamping system is presented herein. The strip holding device includes a magnetic component and a non-magnetic bracket. The magnetic component has at least one pole shoe. The bracket is configured to be connected to the die. Moreover, the magnetic component is installed into a cavity in the metal bracket.

The metal strip holding device may include a second magnetic component with at least one pole shoe. The bracket may be constructed from aluminum, bronze, or stainless steel. The bracket may have a substantially rectangular shape. In certain instances, the magnetic component may have four pole shoes. The cavity may be centrally located in the metal bracket. The strip holding device may be configured to be installed onto the bottom die of a stamping system. The strip holding device may be configured to be installed onto the rail component of the bottom die.

A method of feeding a metallic strip past the die of a stamping system is also presented herein. The feeding method includes the following steps: (a) providing a die of a stamping system; (b) providing an embodiment of the strip holding device presented herein, the holding device being connected to the rail of the die; (c) feeding a portion of the metallic strip next to a portion of the die, to force the rest of the metallic strip downstream in the stamping system; (d) allowing the strip holding device to magnetically hold onto the metallic strip; (e) allowing the die to perform the stamping operation on the portion of the metallic strip; and (f) repeating steps (c), (d), and (e) until completion of the stamping operation.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present system and/or method. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
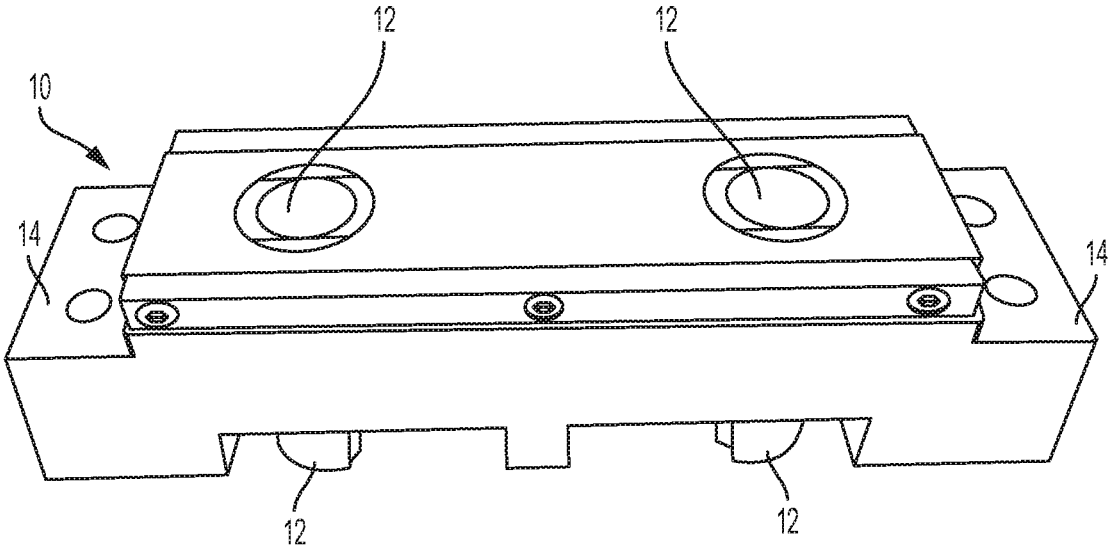
FIG. 1 shows a perspective view of an exemplary embodiment of the strip holding device.
Figure 2:
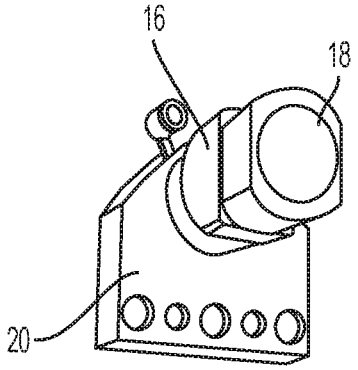
FIG. 2 shows a perspective view of an exemplary magnetic component for the strip holding device of FIG. 1.
Figure 3:
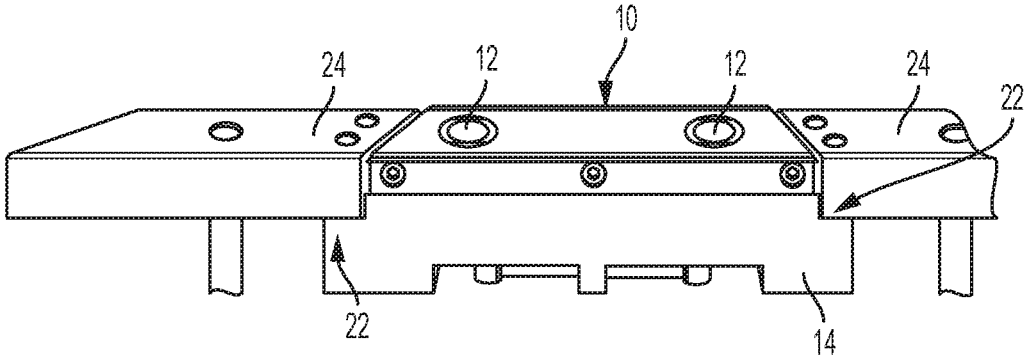
FIG. 3 shows a perspective view of the strip holding device of FIG. 1 in a portion of the exemplary environment.

Referring to FIGS. 1-3, one possible embodiment of a holding device for a strip of steel stock 10 is shown to include two similar magnetic components 12 and a bracket 14. Each magnetic component 12 is generally an air powered industrial magnet with a housing 16 and operative pole shoe 18 (e.g., the "AR" or "AY" Series, End-Of-Arm Tooling Magnets for Automation, as manufactured by Magswitch Technology Worldwide LLC). Within housing 16 may be a rotary actuator, actuator adaptor, and bearing plunger (not shown), which collaborate with each other upon coming into contact with an adapted airflow. The collaboration between these actuators and plunger operatively configures magnetic disks within the pole shoe 18 to generate a magnetic field (deep or shallow field), as is generally known. An air gap may also be located at or near the magnetic disks within housing 16, as is also generally known. Housing 16 may further include a flange mount 20 which can be used to facilitate installation and fastening of the magnet 12 into a cavity of the housing 16 (discussed below).

The bracket 14 may have a rectangular shape with two peripherally extending step features 22, which facilitates the operative installation of holding device 10 onto rail 24 of the stamping system's bottom die 26. The bracket 14 may moreover be constructed from a non-magnetic metal such as, but not limited to, aluminum, bronze, or stainless steel so the magnetic flux will not get transferred into bracket 14 and can remain concentrated around the magnets 12. As can be seen, holding device 10 is operatively installed onto rail 24 via a number of bolts; however, it should be understood that holding device 10 may be operatively installed to rail 24 by other means (e.g., welding, being inserted into a cavity/orifice in the rail body, etc.).

Figure 4:
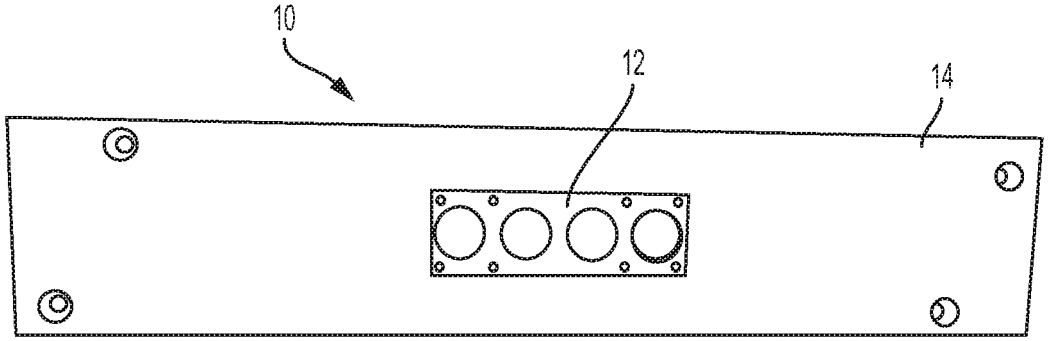
FIG. 4 shows a top view of another exemplary embodiment of the strip holding device.
Figure 5:
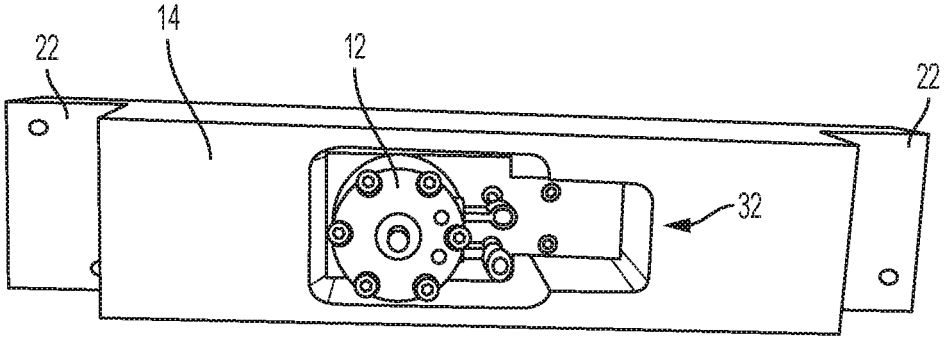
FIG. 5 shows a bottom view of the strip holding device of FIG. 4.
Figure 6:
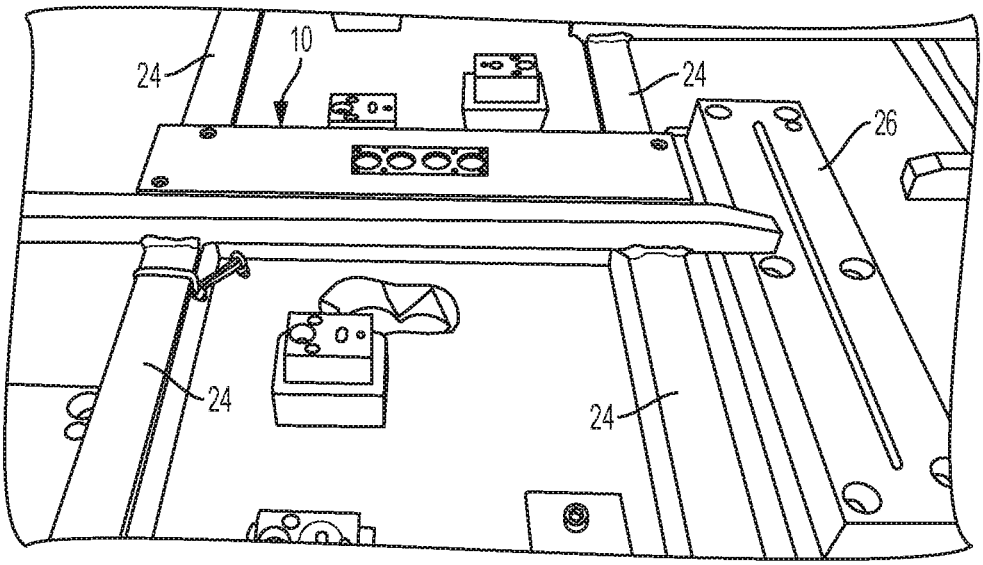
FIG. 6 shows a perspective view of the strip holding device of FIG. 4 in an exemplary environment.

Another embodiment of holding device 10 is shown in FIGS. 4-6. In this embodiment, holding device 10 includes a single magnet 12 with four operative pole shoes 18. As can be seen, magnet 12 may be installed into a centrally-located cavity 32 in bracket 14. As shown, this embodiment of holding device 10 is operatively installed onto two parallel rails 24 and in a perpendicular manner.

To operate holding device 10 an operator of the stamping system feeds a strip of steel stock into the stamping system. The operator then empowers the stamping system. At this point, airflow should also be provided to the magnets 12, and the pole shoes 18 producing a magnetic field. This allows strip holding device 10 to magnetically hold the metal strip in place. The operator will then cause the press to move down and close the die to perform the stamping operation. Once stamping is complete, the airflow may be halted and the pole shoes may be relieved of producing a magnetic field to allow more of the strip to be fed into the system. These steps should be repeated until the metallic strip runs out of feed or stamping operation is considered complete.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the system and/or method that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A metal strip holding device of a holding system having a stamping system, the metal strip holding device configured to be connected to a die of the stamping system, the metal strip holding device comprising:

a bracket comprising a cavity and configured to be connected to the die; and a magnetic component comprising at least one pole shoe, a housing having a cavity in which the magnetic component is disposed in and a flange mount, wherein the flange mount is configured to fasten the housing into the cavity of the bracket.

2. The holding device of claim 1, further comprising a second magnetic component comprising at least one pole shoe.

3. The holding device of claim 1, wherein the bracket is constructed from non-magnetic aluminum, bronze, or stainless steel.

4. The holding device of claim 1, wherein the bracket has a substantially rectangular shape.

5. The holding device of claim 1, wherein the magnetic component comprises four pole shoes.

6. The holding device of claim 1, wherein the cavity is centrally located in the bracket.

7. The holding device of claim 1, wherein the strip holding device is configured to be installed onto the bottom die of the stamping system.

8. The holding device of claim 7, wherein the strip holding device is configured to be installed onto the rail component of the bottom die.

9. A holding device for a strip of steel stock, the holding device configured to be connected to a bottom die of a stamping system, the strip holding device comprising:

a non-magnetic metal bracket comprising a substantially rectangular shape and a centrally-located cavity, wherein the non-magnetic metal bracket is configured to be connected to a rail of a die; and a magnetic component comprising at least one pole shoe and a housing having a cavity in which the magnetic component is disposed in and including a flange mount, wherein the flange mount is configured to fasten the housing into the centrally-located cavity of the non-magnetic metal bracket.

10. The holding device of claim 9, further comprising a second magnetic component comprising at least one pole shoe.

11. The holding device of claim 10, wherein the non-magnetic metal bracket is constructed from aluminum, bronze, or stainless steel.

12. The holding device of claim 10, wherein the magnetic component comprises four pole shoes.

13. A method of feeding a metallic strip past the die of a stamping system, the method comprising:

(a) providing a die of a stamping system;

(b) providing strip holding device connected to a rail of the die, the strip holding device comprising:

a bracket comprising a cavity and configured to be releasably attached to a bottom of the die; and a magnetic component comprising: at least one pole shoe; and a housing having a cavity in which the magnetic component is disposed in and a flange mount, wherein the flange mount is configured to fasten the housing into the cavity of the bracket;

(c) feeding a portion of the metallic strip next to a portion of the die, to force the rest of the metallic strip downstream in the stamping system;

(d) allowing the strip holding device to magnetically hold onto the metallic strip;

(e) allowing the die to perform the stamping operation on the portion of the metallic strip; and (f) repeating steps (c), (d), (e) until completion of the stamping operation.

14. The feeding method of claim 13, wherein the strip holding device further comprises a second magnetic component.

15. The feeding method of claim 13, wherein the bracket is constructed from non-magnetic aluminum, bronze, or stainless steel.

16. The feeding method of claim 13, wherein the bracket has a substantially rectangular shape.

17. The feeding method of claim 13, wherein the magnetic component comprises four pole shoes.

18. The feeding method of claim 13, wherein the cavity is centrally located in the bracket.

19. The feeding method of claim 13, wherein the strip holding device is configured to be connected to the bottom die.

* * * * *